US005433095A

United States Patent [19]

Mitchell et al.

[11] Patent Number: 5,433,095

[45] Date of Patent: Jul. 18, 1995

[54] BASKETBALL HOOP SECURITY DEVICE

[76] Inventors: Thomas M. Mitchell; Louis Thomas; Lydia M. Jones; Michael Thomas, all of 3114 August Tech. Dr., #202, Augusta, Ga. 30906

[21] Appl. No.: 88,663

[22] Filed: Jul. 6, 1993

[51] Int. Cl.[6] ..... B60R 25/02; A63B 71/00

[52] U.S. Cl. ..... 70/209; 70/14; 70/57; 70/226; 273/1.5 R

[58] Field of Search ..... 273/1.5 A, 1.5 R; 70/14, 57, 207, 209-212, 225, 226, 237, 238, 258, 259, 416, 417

[56] References Cited

U.S. PATENT DOCUMENTS

| | | | |
|---|---|---|---|
| 2,694,572 | 11/1954 | Crisp | 273/1.5 A |
| 2,710,189 | 6/1955 | Carroll | 273/1.5 A |
| 2,918,283 | 12/1959 | Marschalk | 273/1.5 A |
| 3,742,743 | 7/1973 | Stoyanovitch | 70/209 |
| 4,206,915 | 6/1980 | Woodcock | 273/1.5 A |
| 4,213,606 | 7/1980 | Wilson | 273/1.5 A |
| 4,226,416 | 10/1980 | Callanan | 273/1.5 A |
| 4,304,110 | 12/1981 | Fain | 70/209 |
| 4,823,573 | 4/1989 | Latta | 70/226 X |
| 4,949,561 | 8/1990 | Solow et al. | 70/209 |
| 5,195,742 | 3/1993 | Bailey | 273/1.5 R |

FOREIGN PATENT DOCUMENTS

| | | | |
|---|---|---|---|
| 562201 | 1/1983 | Australia . | |
| 2468488 | 5/1981 | France | 70/209 |
| 2639591 | 6/1990 | France | 70/226 |
| 2718291 | 10/1978 | Germany | 70/226 |
| 1127524 | 9/1968 | United Kingdom | 70/226 |
| 2039840 | 8/1980 | United Kingdom | 70/209 |

*Primary Examiner*—Peter M. Cuomo
*Assistant Examiner*—Suzanne L. Dino
*Attorney, Agent, or Firm*—James A. Hinkle

[57] ABSTRACT

A basketball-hoop lock has a hoop restriction with a pin-lockable vertical hook on one end and at least one horizontal hook on an opposite end. The vertical hook can be positioned vertically on a portion of a rim of a basketball hoop when an opposite end of the hoop restriction is hooked horizontally on one or more opposing portions of the basketball rim. Positioning a lock pin, a padlock rod or a suitable line through one or more orifices in the vertical hook locks all hooks on the hoop restriction.

4 Claims, 2 Drawing Sheets

BASKETBALL HOOP SECURITY DEVICE

BACKGROUND OF THE INVENTION

I. Field of the Invention

The present invention relates generally to the field of locking mechanisms for locking basketball hoops when not in use and in particular to a pin-lock vertical hook on one end and at least one horizontal hook on an opposite end of a hoop restriction.

II. Description of the Prior Art

There are no known locks for basketball hoops and none are believed to exist. There have been attachments to basketball hoops for aiding basketball practice but not for locking a basketball hoop to prevent its unauthorized use. The need to lock a basketball hoop is a relatively recent development. It is similar to a need for fencing and locking a swimming pool because it is an attractive nuisance. Now a basketball hoop also must be locked to prevent liability of its private or public owner for injury to others from its misuse. Other related needs for locking basketball hoops also exist.

Locking a basketball hoop has similarity in principle to wheel-immobilization locks for car wheels. The similarity exists as a result of circular construction of both. Wheel-immobilization locking is different, however, in that there is no opening through a hub that can be relied on for inserting a locking mechanism. Instead, rotation of a wheel must be blocked by a mechanism that can be positioned on only on an outside periphery of the wheel. Consequently, in U.S. Pat. No. 4,013,265 granted to Richards and in U.S. Pat. No. 4,854,144 granted to Davis for wheel-immobilization devices, there were mechanisms for clamping onto a round object from only an outside periphery. Both had an expandable member that hooked around one side of a wheel and two separated members that hooked around other parts of the wheel. By contrast, a basketball hoop has an open center through which select portions of a locking mechanism can be inserted. This invention makes use of the open nature of the basketball hoop for positioning different types of locking mechanisms in a different working relationship.

SUMMARY OF THE INVENTION

In accordance with the present invention, it is contemplated that in light of the relatively recent need that has developed for locking basketball hoops to prevent their misuse, a primary objective of this invention is to provide a basketball-hoop lock which is effective in preventing unauthorized use of a basketball hoop.

Another objective is to provide a basketball-hoop lock which can be taken off and put on quickly and conveniently.

Another objective is to provide a basketball-hoop lock in one piece that is easy to store and to handle.

Yet another objective is to provide a basketball-hoop lock which is effective against unauthorized removal.

This invention accomplishes the above and other objectives with a basketball-hoop lock having a hoop restriction with a pin-lockable vertical hook on one end and at least one horizontal hook on an opposite end. The vertical hook can be positioned on a portion of a rim of a basketball hoop when an opposite end of the hoop restriction is hooked horizontally on one or more opposing portions of the basketball rim. Positioning a lock pin or a padlock through one or more orifices in the vertical hook locks all hooks on the hoop restriction.

Other objects, advantages and capabilities of the invention will become apparent from the following description taken in conjunction with the accompanying drawings showing preferred embodiments of the invention.

DESCRIPTION OF THE PREFERRED EMBODIMENTS

Figure 1:
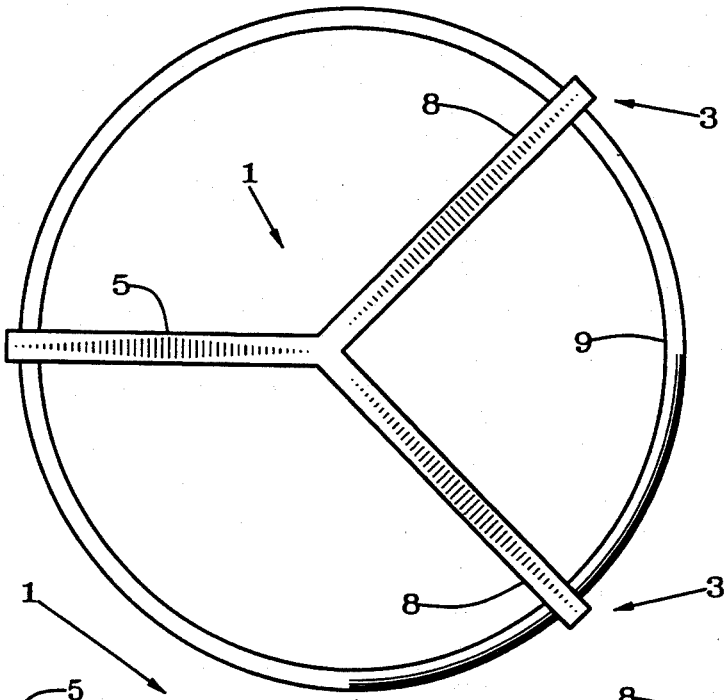
FIG. 1 is a is a top view of a Y-shaped embodiment of this basketball-hoop lock having a plurality of inwardly extended horizontal hooks and mounted on a hoop rim.
Figure 2:
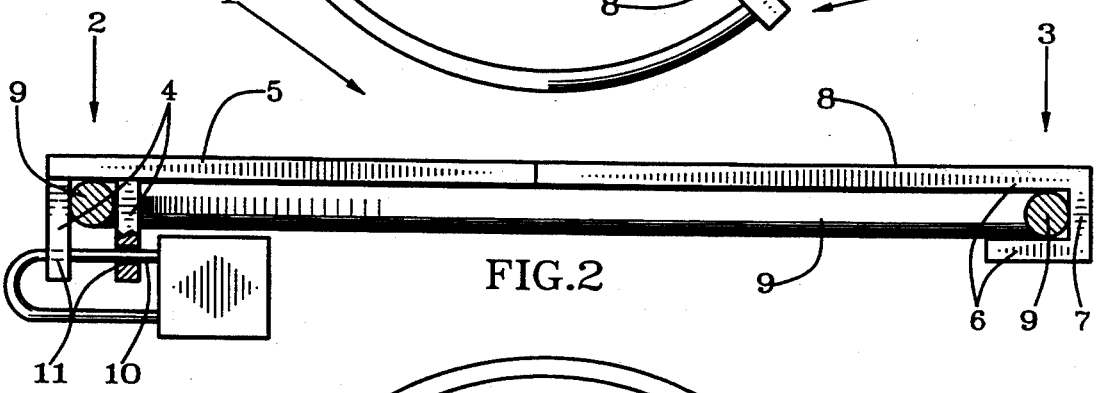
FIG. 2 is a partial cutaway side view of the FIG. 1 illustration.
Figure 3:
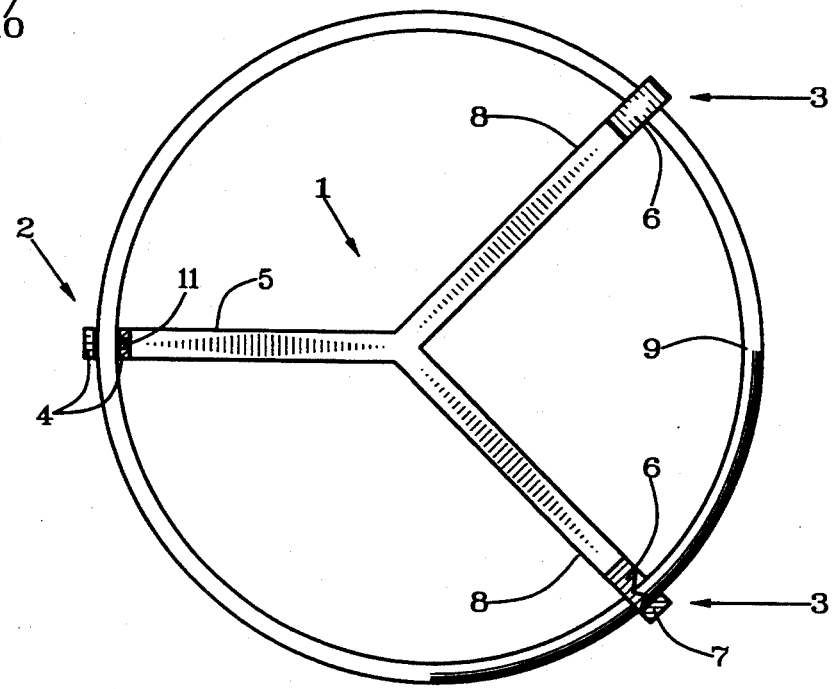
FIG. 3 is a partial cutaway bottom view of the FIG. 1 illustration.

Referring to the drawings wherein like reference numerals designate corresponding parts throughout the several figures, reference is made first to FIGS. 1–3. A hoop restriction 1 has a vertical hook 2 and at least one horizontal hook 3. The vertical hook 2 has two vertical-hook arms 4 extended downward vertically from a lock end 5 of the hoop restriction 1. The at-least-one horizontal hook 3 can have two inward-extending horizontal-hook arms 6 extended radially inward from a horizontal-hook bifurcation 7 that is attached to at least one hook end 8 of the hoop restriction 1.

To use this embodiment having inward-extending horizontal-hook arms 6, the horizontal-hook bifurcation 7 of each of the at-least-one horizontal hooks 3 is positioned first in contact with an outside periphery of a hoop rim 9. Then the vertical hook 2 is positioned vertically on the hoop rim 9 with a vertical-hook arm 4 on each side of the hoop rim 9. Locking is then accomplished by inserting a padlock bar 10, a lock pin, a flexible line or other locking member into a lock orifice 11 in at least one of the vertical-hook arms 4. A padlock bar 10 extending through the lock orifice 11 in both of the vertical hook arms 4 is an illustrated preference.

Figure 4:
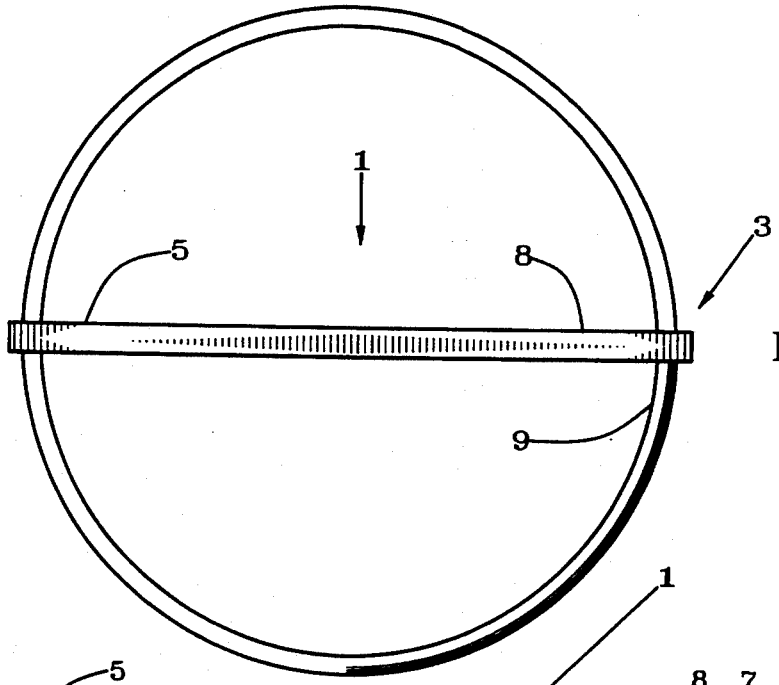
FIG. 4 is a top view of single-bar embodiment of this invention having an outwardly extended horizontal hook and mounted on a hoop rim.
Figure 5:
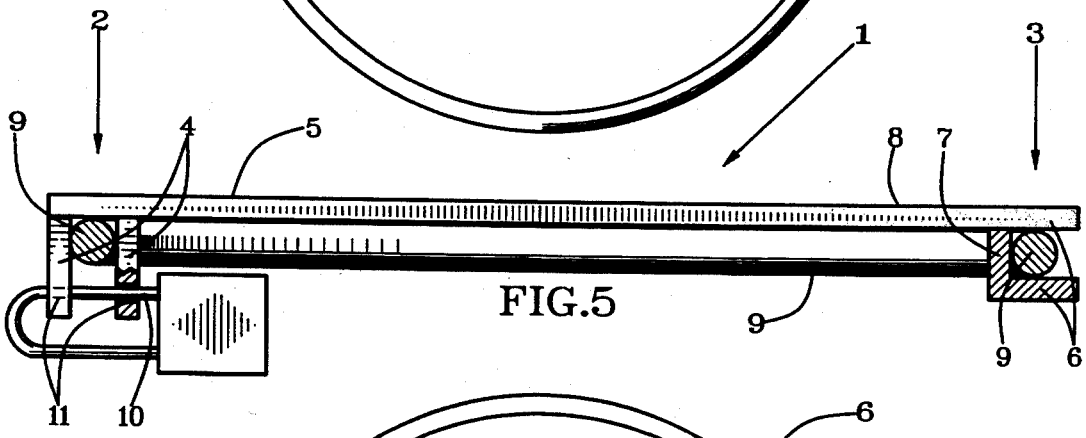
FIG. 5 is a partial cutaway side view of the FIG. 4 illustration.

Referring to FIGS. 4 and 5, the hoop restriction 1 can be a single bar with the same vertical hook 2 and with the same horizontal hook 3 but with one slight modification of the same principle for a locking mechanism. The horizontal hook 3 is reversed. The horizontal-hook arms 6 are extended outwardly instead of inwardly from the hoop end 8 of the hoop restriction 1. The bifurcation 7 of the horizontal hook 3 is then positioned in contact with or proximate an inside instead of an outside periphery of the hoop rim 9 before lowering the vertical hook 2 onto a top surface of the hoop rim 9.

The single-bar embodiment is preferable for some applications. It is best used with a slightly wider horizontal hook 3. Also, the bar which comprises the body of the hoop restriction 1 can be expanded horizontally into a larger form of the hoop restriction 1 between the lock end 5 and the hook end 8.

Figure 6:
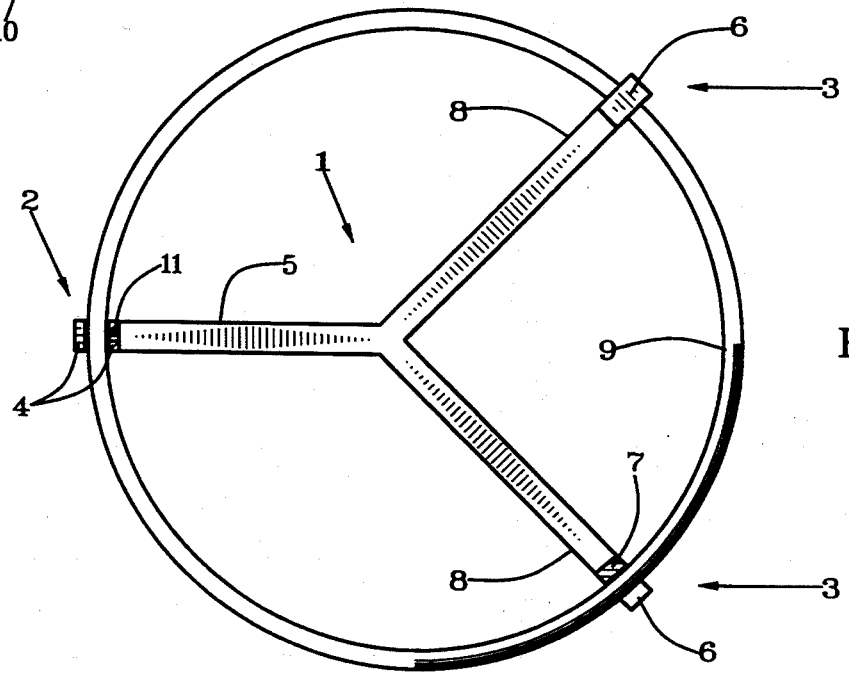
FIG. 6 is a partial cutaway bottom view of Y-shaped embodiment having a plurality of outwardly extended horizontal hooks and mounted on a hoop rim.

Referring to FIG. 6, a hoop restriction 1 with a Y-shape can have a plurality of horizontal hooks 3 with horizontal-hook arms 6 that extend outwardly with the bifurcation 7 positioned in contact with the inside periphery of the hoop rim 9 for locking. For the Y-shaped hoop restriction 1 or for other shapes with a plurality of horizontal hooks 3 separated, use of horizontal-hook arms 6 that are extended inwardly or outwardly from the hook end 8 of the hoop restriction 1 is optional. For a hoop restriction 1 with a single bar or other form using a single horizontal hook 3, however, the horizontal hook 3 with a horizontal-hook arm 6 extending outward instead of inward from the hoop restriction 1 is necessary.

Regardless of which embodiment is used, however, the principle is the same. The concept is the same and the effects are the same.

The term bifurcation is used to describe a point of separation of one part into two parts comprising horizontal-hook arms 6 because it is the same in principle as employing some other shape of horizontal hook 3. It is a foreseeable substitution of equivalents to shape the horizontal hooks 3 with the horizontal arms 6 slanted parallel or slanted equally upward and downward in a Y-shape with one horizontal-hook arm 6 vertically above the other. Terms to describe the horizontal-hook principle in a manner to include such foreseeable modifications is employed. Hence the term bifurcation 7 is used to describe a vertical member and a top arm 6 describes an extension of the hook end 8 of the hoop restriction 1 in a preferred embodiment of this invention.

Various modifications may be made of the invention without departing from the scope thereof and it is desired, therefore, that only such limitations shall be placed thereon as are imposed by the prior art and which are set forth in the appended claims.

What is claimed is:

1. A basketball-hoop lock comprising:

restriction means to restrict ingress of a ball into an area defined by a basketball-hoop rim, the restriction means comprising a planar structure having at least three horizontally disposed arms, at least one of said arms being a securing arm, and at least one of said arms being a locking arm, the arms being joined at a juncture point within the area defined by the basketball-hoop rim, each horizontally disposed arm having a proximal end, each proximal end of each arm being joined at the juncture point within the area defined by the basketball-hoop rim, and each arm having a distal end being substantially co-extensive with and overlying the basketball-hoop rim, an open area being defined between adjacent arms and the basketball-hoop rim, at least one securing arm having at its distal end a basketball-hoop rim engaging structure to maintain the said securing arm securely attached to the basketball-hoop rim, the basketball-hoop rim engaging structure of each securing arm comprising an L-shaped clip attached to the distal end of each securing arm and engaging the basketball-hoop rim, at least one locking arm having at its distal end a basketball-hoop rim locking structure to maintain the said locking arm securely attached to the basketball-hoop rim, the basketball-hoop rim locking structure of each locking arm comprising parallel locking members depending from the distal end of each locking arm, and wherein each locking member is juxtaposed to the basketball-hoop rim in a manner that the depending locking members flank the sides of the basketball-hoop rim, and each locking member having a through aperture therein, which apertures are in axial alignment with one another to provide access for locking means to be inserted therethrough, the basketball-hoop rim having an upper rim surface and a lower rim surface, the axially aligned apertures being disposed adjacent to the lower rim surface.

2. A basketball-hoop lock as claimed in claim 1, wherein the basketball-hoop rim defines a center point within the rim area, each securing arm and each locking arm being joined substantially at the center point.

3. A basketball-hoop lock as claimed in claim 2, wherein each securing arm and each locking arm project from the center point horizontally in a select direction toward the basketball-hoop rim.

4. A basketball-hoop lock as claimed in claim 3, wherein the securing arms and the locking arms are arranged rigidly in a Y-shape.

* * * * *